US005842370A

United States Patent [19]

Hofele et al.

[11] Patent Number: 5,842,370

[45] Date of Patent: Dec. 1, 1998

[54] TRANSFER DEVICE AND MULTISTATION PRESSES

[75] Inventors: Hans Hofele, Goeppingen; Peter Klemm, Stuttgart; Juergen Eltze, Goeppingen; Stefan Veit, Donzdorf; Kurt Metzger, Goeppingen, all of Germany

[73] Assignee: Schuler Pressen GmbH & Co., Germany

[21] Appl. No.: 770,710

[22] Filed: Dec. 19, 1996

[51] Int. Cl.[6] ..... B21D 43/05

[52] U.S. Cl. ..... 72/405.09; 198/621.1; 72/405.1

[58] Field of Search ..... 72/405.1, 405.11–405.16, 72/405.01; 414/752, 751; 198/621.3, 621.1

[56] References Cited

U.S. PATENT DOCUMENTS

| | | | |
|---|---|---|---|
| 4,487,409 | 12/1984 | Orii | 72/405.1 |
| 5,001,921 | 3/1991 | Schneider | 72/405.13 |
| 5,006,028 | 4/1991 | Jackson | 198/621.1 |
| 5,140,839 | 8/1992 | Bruns | 72/405 |
| 5,385,040 | 1/1995 | Michael | 72/405.1 |

FOREIGN PATENT DOCUMENTS

| | | | |
|---|---|---|---|
| 221228 | 9/1991 | Japan | 72/405.01 |
| 1433594 | 10/1988 | Russian Federation | 72/405.09 |

*Primary Examiner*—Daniel C. Crane
*Attorney, Agent, or Firm*—Evenson, McKeown, Edwards & Lenahan, P.L.LC.

[57] ABSTRACT

A transfer device is provided particularly for multistation presses and is arranged between two working stations. The transfer device has a suction bridge which extends transversely with respect to a transfer direction and which is guided on its ends by two control arm gearings synchronously along a predetermined transfer curve. The control arm gearings are formed by control arms or rods which are connected on the end side with the cross traverse and which, on their respective end situated away from the cross traverse 46, are held in preferably vertically aligned linear axles, in which case the control arms, in respective pairs, enclose the same angle with one another. By the targeted controlling of the linear axles, almost arbitrary transfer curves can be travelled within the scope of the range of the transfer device. All linear axles are directly supported on a stationary frame whereby a high stiffness and precision is achieved even at high accelerations.

14 Claims, 7 Drawing Sheets

TRANSFER DEVICE AND MULTISTATION PRESSES

The invention relates to a transfer device for transferring workpieces from one working station into a machining station which follows in the machining sequence as well as to a transfer system constructed of such transfer devices and to a multistation press having such transfer devices.

In the case of multistation presses or other systems having several successive working stations, a transfer system is required for transporting the workpieces. For this purpose, the transfer system must, as a rule, grip the workpiece, guide it out of the respective working station, transport it to the next working station and deposit it there. Then corresponding gripping and holding devices of the transfer system must be guided so far out of the working station that they will not collide with the tool acting upon the workpiece.

From U.S. Pat. No. 4,887,446, a three-axle transfer system for transfer presses has become known. The transfer system includes two transfer rails which extend in the workpiece passage direction along several press stations. The transfer rails carry holding devices for the workpieces. The holding devices are held on a longitudinal member which is longitudinally displaceably disposed on the transfer rail and can be driven in the longitudinal direction by way of an electric linear drive. Additional linear units have the purpose of moving the transfer rails toward one another and away from one another and of synchronously lifting and lowering them.

In this case, the longitudinal drive is supported on an intermediate member which, in turn, can be moved in the transverse direction (opening, closing) as well as in the vertical direction (lifting, lowering). The driving forces of each axle must be applied only by the drives assigned to the corresponding axle while the other drives or guides are loaded by means of these forces in the lateral direction. In addition, in the case of this transfer device, all holding devices necessarily operate synchronously.

From German Patent Document DE 42 37 312 A1, a transfer press having a two-axis transfer is known. Grippers held on cross traverses are used for transporting workpieces. On their ends, the cross traverses are held on transfer rails which form carrier devices for them. The transfer rails are to be moved by corresponding driving units only in the longitudinal and in the vertical direction. As required, intermediate depositing devices may be provided between the press stations and temporarily receive the workpieces, optionally newly align them; for example, rotate them about their transverse axis, as required when the workpieces are to be machined in successive press stations at a different angle.

In the case of this two-axis transfer, the driving devices are operationally arranged behind one another; that is, the output of a driving device is fully loaded with the mass of the driving devices connected behind it.

WO93/00185 discloses a transfer system having suction bridges which are held on the end side in each case on an electric driving unit and whose characteristics form the preamble of claim 1. Each driving unit is constructed as a lifting and transfer unit and has a telescopable arm which extends downward in the vertical direction. On its lower end, a lever is arranged which can be rotated by means of a servo motor about a vertical axis. This lever is connected by way of a connecting rod with one end of a cross traverse carrying suction devices. The lever and the connecting rod carry the cross traverse and thus form a carrying device for it.

The acceleration forces which occur in the passage direction during the acceleration of the suction bridge must be absorbed by the telescopable arm which extends in the downward direction.

Furthermore, shears or rod arrangements are known from practice by means of which, for example, tools can be guided on complicated paths.

In addition, the transfer curves are dependent on the respective machined workpieces and must be adapted when a workpiece series is changed and when the tools are changed. Also, the transfer device should require as little time as possible for the workpiece transfer.

This results in the object on which the invention is based which is to provide a flexibly usable transfer device which permits a high working speed of the working stations serviced by it. In addition, it is an object of the invention to provide a multistation press which has a high working speed and can be retooled in a simple manner with respect to different workpieces.

In its simplest form, the transfer device according to the invention has a cross traverse with at least one holding device. On both ends, the cross traverse is carried by control arm gearings which in the simplest case are formed by control arms, such as rods, stressed predominantly with respect to push and pull. Each control arm gearing is connected with, for example, two driving units arranged at a distance with respect to one another. The driving units are preferably linear axles which are a arranged at a distance in parallel to one another. However, they may also be integrated into the control arms. The connection points between the control arms and the connection points between the control arms and the driving units define a triangle or trapezoid. As a result, by means of a coordinated control of the individual driving units, a defined movement of the cross traverse in a direction determined by the direction of the output ends of the driving units as well as transversely thereto can be achieved. Therefore, within a predetermined maximal range, almost arbitrary transfer curves can be adjusted.

For the cross traverse, the driving forces supplied by both control arm gearings are added up so that the force required for accelerating, braking, lifting and lowering the cross traverse is applied jointly by all driving units. In contrast to the known transfer devices, the forces of the driving units on the holding device add up corresponding to the angular conditions defined by the control arms. In addition, the reaction forces of each driving unit are supported directly on the frame which permits a high stiffness and precise guiding of the holding devices. In contrast, in the case of the previously known devices, the driving unit assigned to the vertical direction must absorb the reaction forces of the driving unit for the longitudinal direction.

If they are constructed as straight rods, the control arms enclose an angle with one another which differs from zero. The control arms are connected with the driving units and the holding device preferably by way of hinges which preferably permit only the rotation about a hinge axis. All hinge axes are aligned essentially in parallel to one another. The holding device thereby receives its lateral guidance. Within the scope of the required precision, it is guided in a plane so that the achievable transfer curve is two-dimensional. In an advantageous embodiment, the two control arm gearings have the same effect; that is, they are constructed and arranged, for example, mirror symmetrically with respect to one another. The driving units of the control arm gearings can then be combined in pairs whereby the transfer device requires only two driving units.

Although, in principle, the driving units operate also in the direction of the respective control arm device or may be integrated in it, it is usually also advantageous to construct these as separate linear units which, as a rule, results in an improved guidance. The linear units may, for example, be hydraulic or electric drives. Servo motors may be provided as electric driving units which, by means of corresponding gearings, such as a spindle-type elevating gearing, a synchronous belt gearing or a toothed rack, generate a corresponding linear movement. As an alternative, direct electric drives, such as asynchronously or synchronously operating linear motors, may also be used.

Parallel operating directions of the linear drives result in clear geometric conditions so that a calculation of the control signals of the individual driving units to be carried out by a control unit can be carried out at acceptable expenditures for generating a desired transfer curve. If slightly higher computing expenditures are accepted in this case, eccentric or crank gears operated by servo motors can also be used as the driving units whose output end is guided on a circular-arc-shaped path.

A third control arm device, which forms a parallelogram guide with one of the above-mentioned control arm devices, may be provided for ensuring that the holding device travels through the transfer curve with a uniform angular alignment. As an alternative or in addition, the holding device may be provided with a separate swivel drive which causes a rotation with respect to the cross traverse.

As required, a control arm of the parallelogram guide may also be provided with a separate driving device in order to cause a targeted swivelling of the holding device.

When larger workpieces are to be transported by means of the transfer device, each control arm device contains two mutually parallel control arms whose respective end is connected with a cross traverse extending between both control arms. On its respective other end, each control arm is guided on a linear axle. Both linear axle extend in parallel to one another and are operated synchronously. The linking of both control arms to a single linear axle can be carried out by way of a corresponding cross member.

Corresponding advantages also apply to a multistation press which contains at least one transfer device according to the invention. The transfer curve for the linking of the successive press stations can be flexibly adjusted by means of the transfer device, in which case, the common effect of the driving units when accelerating and braking the holding device, can achieve a fast transfer and thus a high timing rate of the press stations.

As a rule, intermediate depositing devices are not necessary. As a required, swivel units can be provided for this purpose on the holding devices.

Advantageously, a separate transfer device is arranged between two successive press stations respectively so that the multistation press has two separately controllable transfer devices. As a result, the transfer curves between individual press stations can be travelled through in a time-offset manner and it becomes possible to let the individual press stations operate in a time-offset manner. If, for example, a workpiece has been taken out of a press station and its tool begins to close again, the successive tool will still be opening while the transfer device moves the workpiece toward this tool. The offset operating method of the individual press stations results in a more uniform reduction of force so that the required centrifugal mass of the main press drive can clearly be reduced. In addition, it becomes possible by means of the time-offset operating of successive press stations to carry out the workpiece transfer at least partially during the operating of working stations which are arranged in front or behind them so that the proportion of the transfer time of the whole timing period will clearly fall. This can also increase the timing rate without the requirement of increasing the transfer speed for this purpose.

As required, however, several transfer devices, which are situated between different press stations, can also be combined to form a transfer group and are connected with one another by way of transfer rails.

Embodiments of the invention are illustrated in the drawing.

Figure 1:
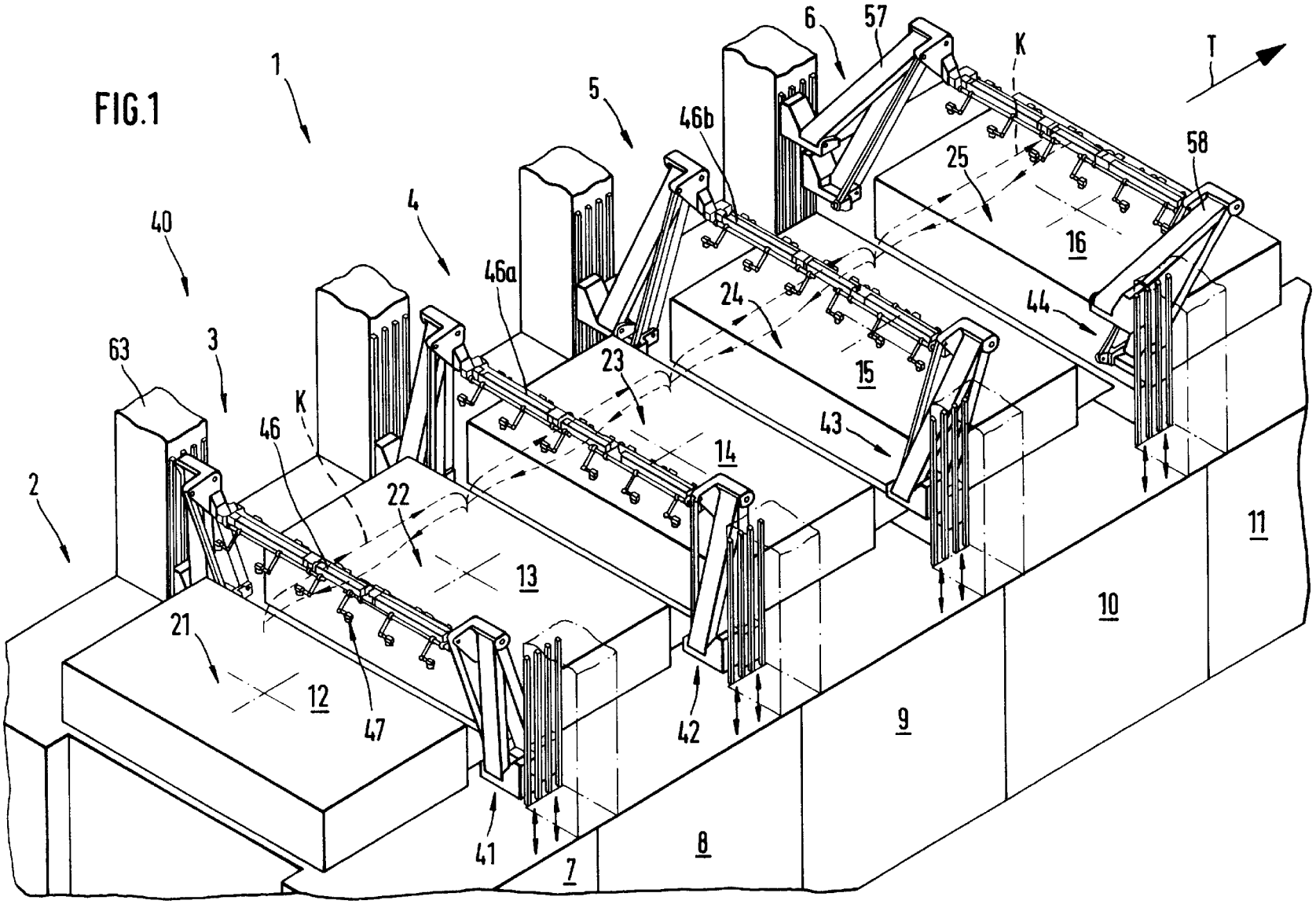
FIG. 1 is a schematic, cutout-type perspective representation of a multistation press with two-axis transfer devices between individual press stations.

FIG. 1 outlines a multistation press 1 by means of its working stations 2, 3, 4, 5, 6. Each working station 2, 3, 4, 5, 6 has a table 7, 8, 9, 10, 11 which carries a sliding table 12, 13, 14, 15, 16 (FIG. 2) on its top side. Dies or bottom tools 21, 22, 23, 24, 25 which are part of the respective tool are arranged on the sliding tables 12 to 16. Top tools 32, 33, 34, 35, 36, which are arranged on slides 27, 28, 29, 30, 31 are assigned to the bottom tools and are moved up and down with the slides. An eccentric or a hinge drive is in each case used as the drive. The eccentrics (drives) of all working stations 2 to 6 are driven by a common shaft which is not shown in detail.

With respect to a passage direction T, the working stations 2 to 6 are arranged behind one another and are linked to one another by means of a transfer system 40 which is formed by separate transfer devices 41, 42, 43, 44. The transfer devices 41 to 44 each have the same construction. The description of the transfer device therefore applies to all other transfer devices. For the purpose of a reference, the parts and elements of the transfer devices 42 to 44 are marked with the same reference symbols as the transfer device 41 which, for the purpose of a differentiation, are each provided with a letter index.

The transfer device 41 is arranged between the working stations 2 and 3. It has a cross traverse 46 which is to be moved along a transfer curve K. The cross traverse 46 carries two suction spiders 47 and therefore forms a holding device for the workpieces. Along the transfer curve K, the cross traverse 46 can be moved to the bottom tool 21 as well as to the bottom tool 22 which follows.

Figure 3:
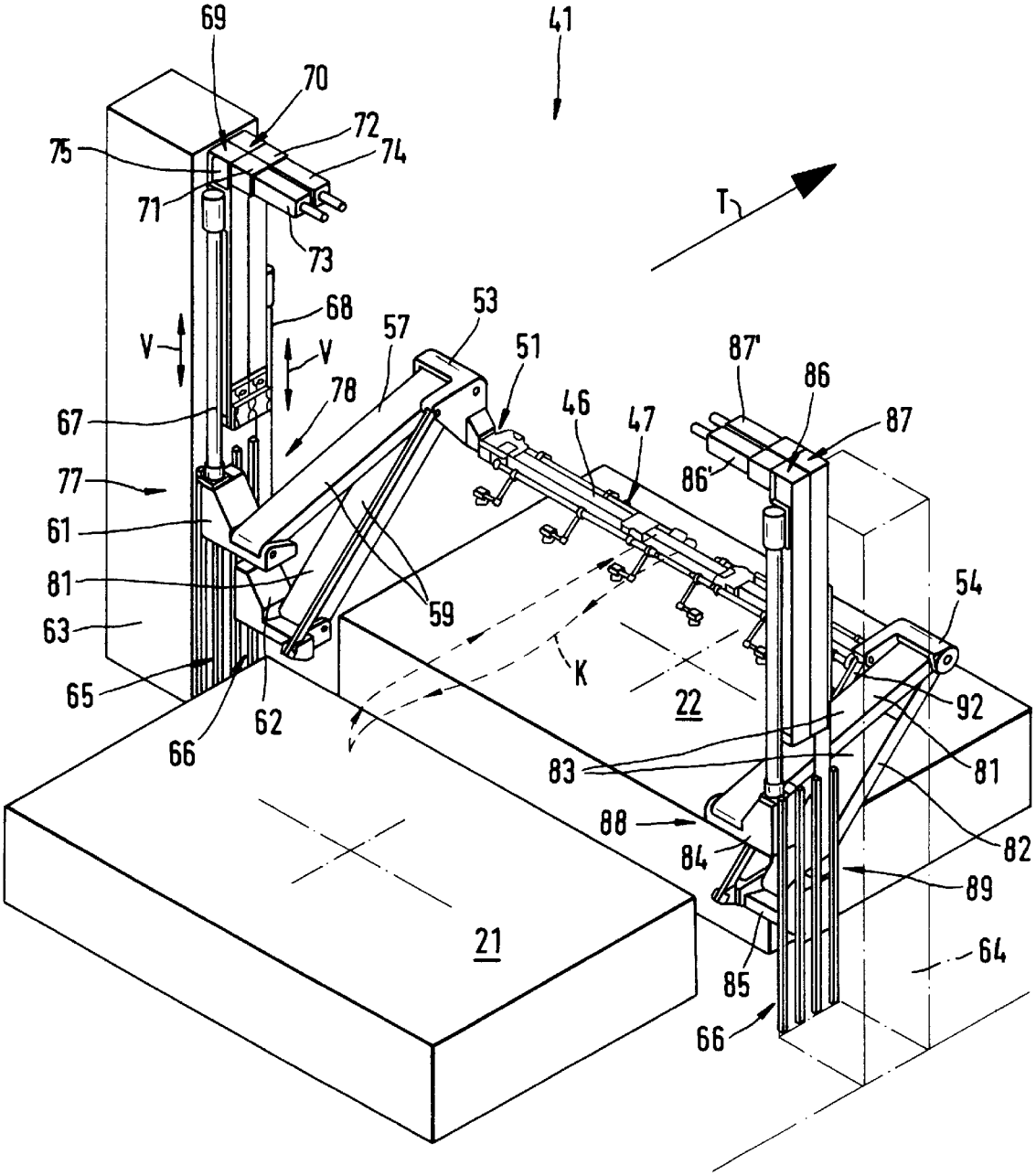
FIG. 3 is a perspective representation of the two-axis transfer device of the multistation press according to FIGS. 1 and 2.
Figure 4:
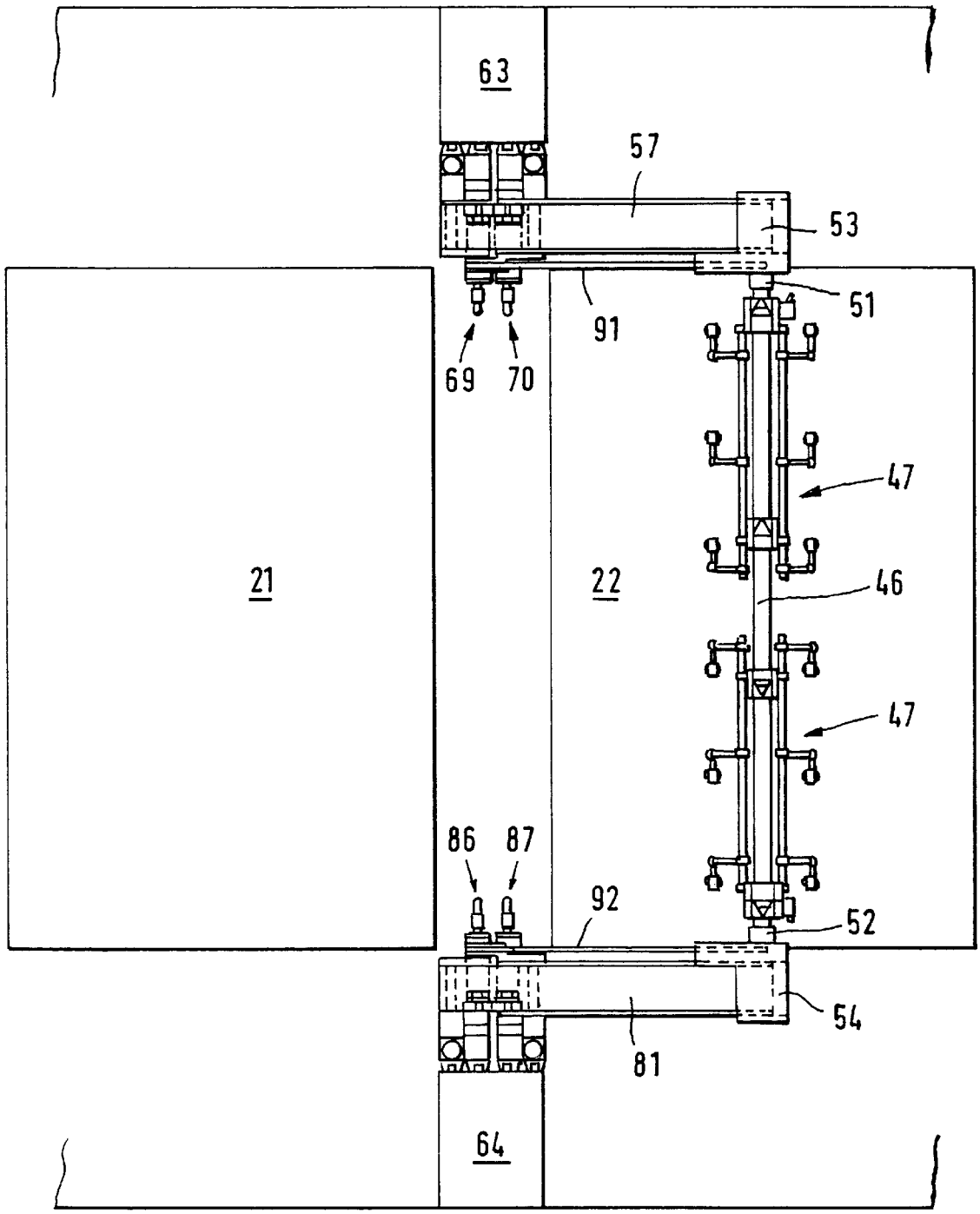
FIG. 4 is a top view of the transfer device according to FIG. 3.

According to FIGS. 3 and 4, the cross traverse, which extends transversely with respect to the transfer direction T, is connected on its two ends 51, 52 with hinge units 53, 54. Two control arms 57, 58 connected with the hinge unit 53 together form a control arm gearing 59 which is used for guiding the cross traverse 46 on its one end. The control arms 57, 58 of the transfer device 41 constructed symmetrically with respect to a vertical longitudinal center plane are swivellably disposed on the hinge unit 53 by means of one end in each case with a coinciding hinge axis. By means of their end situated away from the hinge unit 53, the control arms 57, 58 are each connected with a vertically displaceably disposed carriage 61, 62.

Guide rails 65, 66 provided on the press stands 63 are used for the bearing of the carriages 61, 62. By way of connection rods 67, 68, the carriages 61, 62 are connected with linear units 69, 70 and can be adjusted in the lifting or vertical direction V. The linear units 69, 70 include servo motors 73, 74 which are provided with gearings 71, 72 and which are guided by a control unit not shown in detail by means of position signals. For converting the linear movement generated by the servo motors 73, 74 and the gearings 71, 72 toothed belts 75 are used which are connected at one pint with the respective connection rod 67, 68. The carriages 61, 62 and the elements provided for their guiding and drive form driving units 77, 78 which are controlled corresponding to the desired transfer curve K.

Mirror-symmetrically thereto, the hinge unit 54 is connected by way of hinges with control arms 81, 82 which are guided in parallel to one another and form a control arm gearing 83. At their respective end situated away from the hinge unit 54, the control arms 81, 82 are connected in a hinged manner with carriages 84, 85 which are disposed so that they can be moved linearly up and down on the press stand 64. Combined with the linear units 86, 87 and their servo motors 86', 87', the carriages 84, 85 form driving units 88, 89 for an additional common axis V.

Auxiliary control arms 91, 92 are disposed on the carriages 62, 85 and are in parallel to the control arms 58, 82 and are connected by means of their respective one end with the hinge unit 53, 54. The control arm 58 and the auxiliary control arm 91 form a parallelogram guide for fixing the position of the cross traverse 46 with respect to the transverse axis. The same applies to the control arm 82 and the auxiliary control arm 92.

Figure 2:
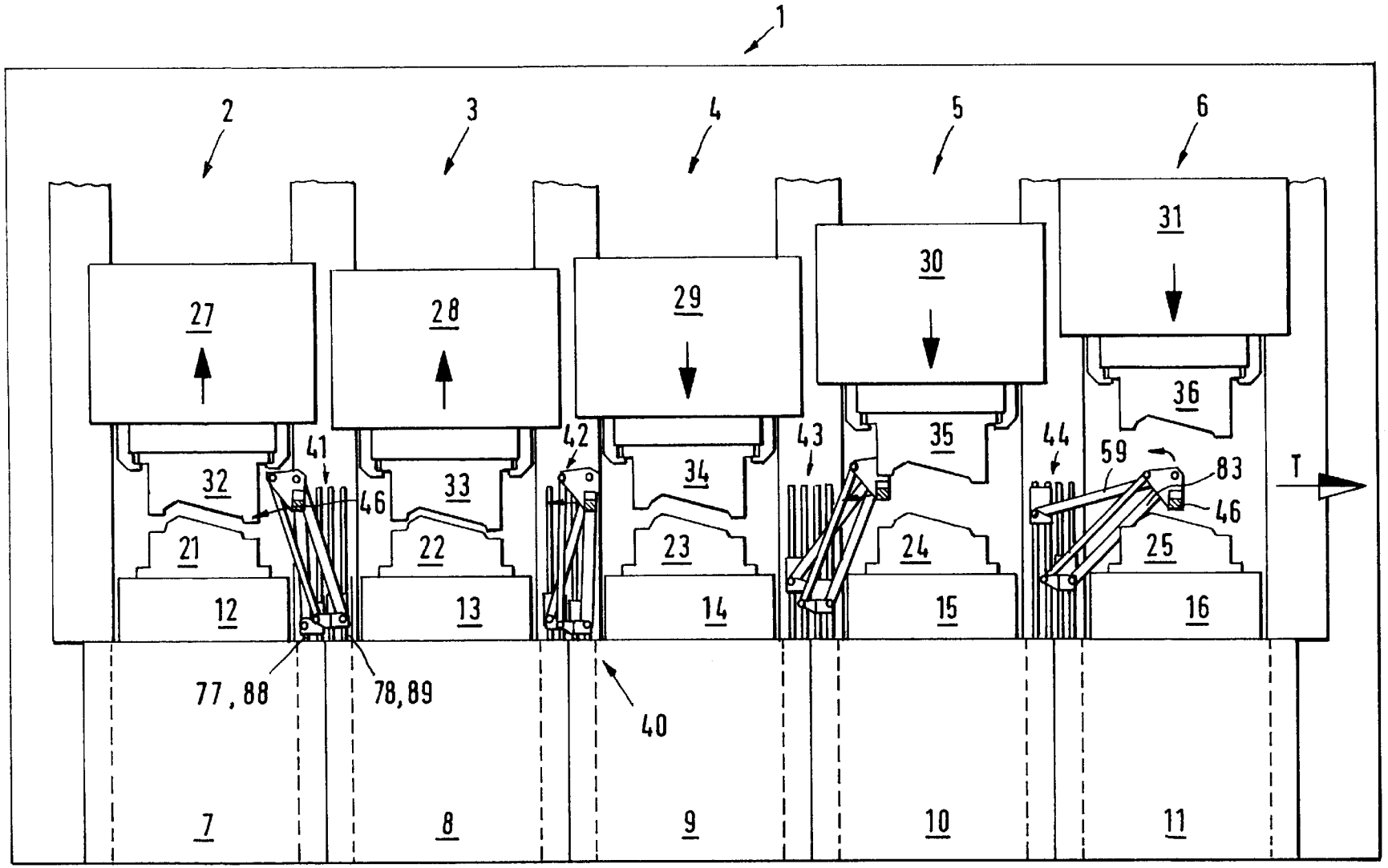
FIG. 2 is a diagrammatic lateral view of a multistation press according to FIG. 1.

The above-described multistation press 1 operates as follows:

As illustrated in FIG. 2, the slides 27 to 31 of the multistation press 1 move up and down with a mutual phase offset. The movement of the transfer devices 41 to 44 is adapted thereto such that the cross traverses 46 with the suction spiders 47 are in each case situated outside the tools when these are closed. For example, in the working station 2, the top tool 32 has lifted off the bottom tool 21 and the slide 27 moves upwards. For removing the workpiece from the bottom tool 21, the cross traverse 46 of the transfer device 41 is moved into the opening tool. For this purpose, the linear driving units 77, 78; 88, 89, which in FIG. 2 are indicated only by means of broken lines, are controlled synchronously with respect to one another such that the cross member 46 carried by the control arm gearings 59, 83 is moved along the transfer curve K.

While the transfer device 41 has removed the workpiece from the bottom tool 21, the adjacent slide 28 has travelled through its lower dead center and lifts the top tool 33 off the bottom tool 22. The transfer device 41 causes, by means of a corresponding controlling of the first driving units 77, 88 and of the second driving units 78, 89, a moving of the control arm pairs 57, 81; 58, 82 and of the cross member 46 carried by them, whereby the workpiece is deposited on the bottom tool 22. After the detaching of the workpiece, the cross member 46 moves back, in which case the tool 22, 33 closes.

The transfer devices 42 to 44 of the working stations 3 to 6 which follow operate correspondingly. The phase offset between the individual working stations 2 to 6 is dimensioned such that the press slide situated downstream with respect to the passage direction T follows its press slide which moves ahead of it upstream by the transport time between the tools of the transfer device which is in each case arranged in-between.

According to the control of their driving units 77, 78; 88, 89, the transfer devices 41 to 44 may travel through different transfer curves and can be adapted in this manner to different workpieces and tools. In the case of a malfunctioning or failure of a transfer device 41 to 44, there is only a danger that the failed transfer device may be damaged. The other transfer devices will not be damaged so that the damage remains limited.

Figure 5:
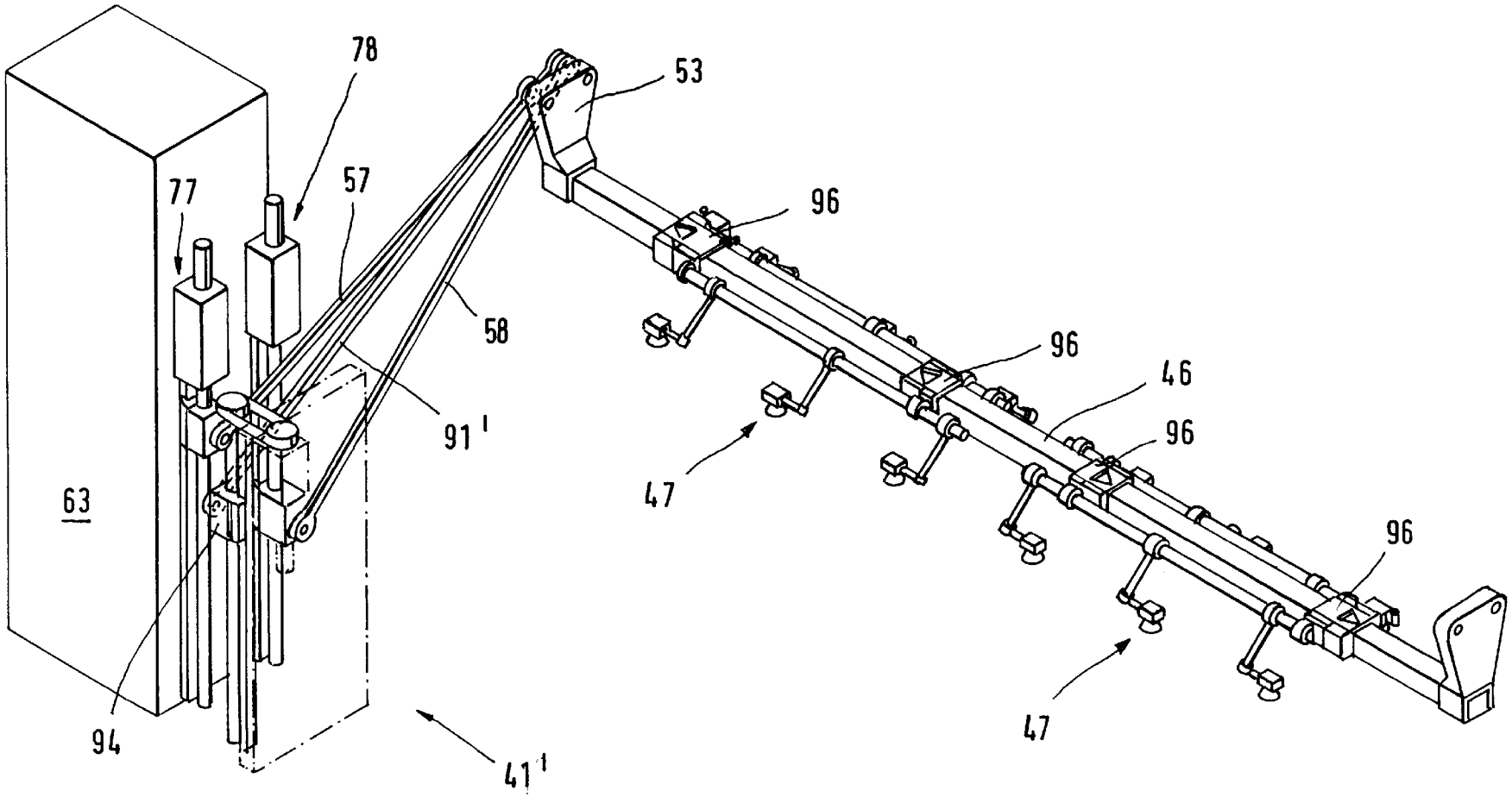
FIG. 5 is a cutout-type, perspective representation of a modified embodiment of the two-axis transfer for a transfer press according to FIGS. 1 and 2.

A modified transfer device 41' is illustrated in FIG. 5. As far as the transfer device 41' corresponds to the above-described transfer device 41, reference is made to its description. Without a repeated reference, the same reference symbols are used as the basis. The difference consists of the fact that, instead of the parallelogram guide, an auxiliary control arm 91' is provided which, by means of one end, is linked to the hinge unit 53 and, by means of its other end, is linked to a third drive unit 94. This defines a third axis V which is aligned in parallel to the axes V defined by the driving units 77, 78. While the control arms 57, 58 with the common swivel axis are linked to the hinge unit 53, the linking point of the control arm 91' is spaced away therefrom. Thus, as illustrated in FIG. 6, the cross traverse 46 can be swivelled in a defined manner by a corresponding targeted control of the driving units 77, 78, 94.

Figure 6:
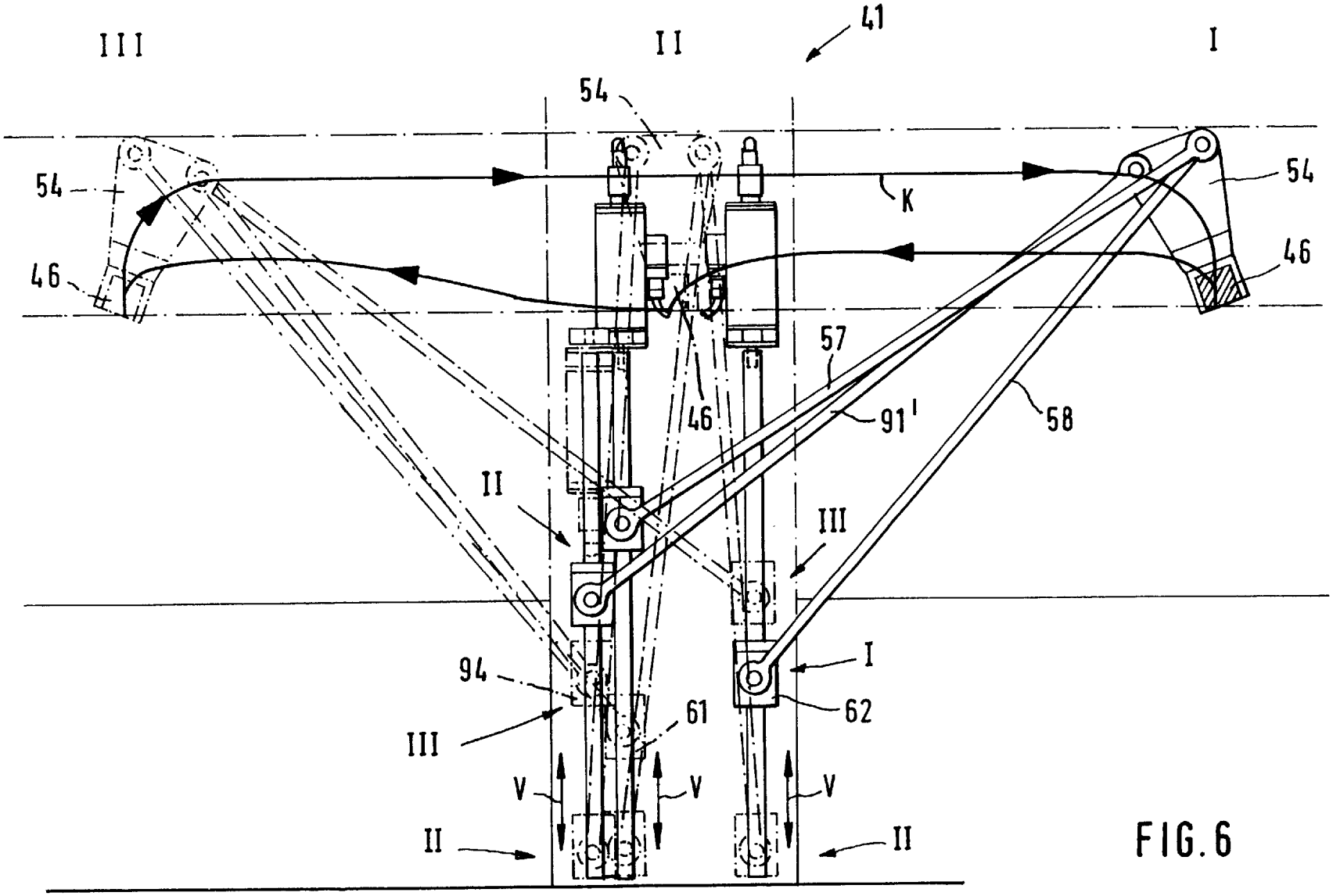
FIG. 6 is a diagrammatic lateral view of the transfer device according to FIG. 6, showing different path points of a travelled transfer curve.

In FIG. 6, the transfer device 41 is illustrated in three different positions I, II and III (from the right to the left) in which the cross traverse 46 takes up three different positions on the transfer curve K. The pertaining carriage positions of the linear units are also marked I, II, III.

For the targeted rotation of the suction spider 47, in the case of the transfer device 41 according to FIG. 3, a rotary unit can be arranged, instead of the third driving unit 94, on the cross traverse 46 which rotary unit swivels the suction spider 47 in a defined manner with respect to the cross traverse 46. Independently of whether the suction spider 47 is fastened on the cross traverse 46 in a swivellable or non-swivellable manner, coupling units 96 may have the purpose of exchanging the suction spiders 47 during the tool change or for maintenance purposes.

Finally, it is possible to control the right-side and left-side linear drives of the transfer device 41 in different manners, in which case, one additional hinge respectively must be provided, for example, between the bearing units 53, 54 and the cross traverse 46, the hinge axis of the hinge pointing, for example, in the transfer direction T. This permits a tilting of the cross traverse 46 about a longitudinal axis situated in the transfer direction T.

If additional hinges and possibly a length compensation are provided on the cross traverse 46, in the case of a controlling of the right-side and left-side linear units 69, 70; 86, 87 in opposite directions, a swivelling of the cross traverse 46 about a vertical axis can be achieved which further increases the flexibility of the drive. As required, the linear units 69, 70; 86, 87 may also be provided on the tables 7, 8.

Figure 8:
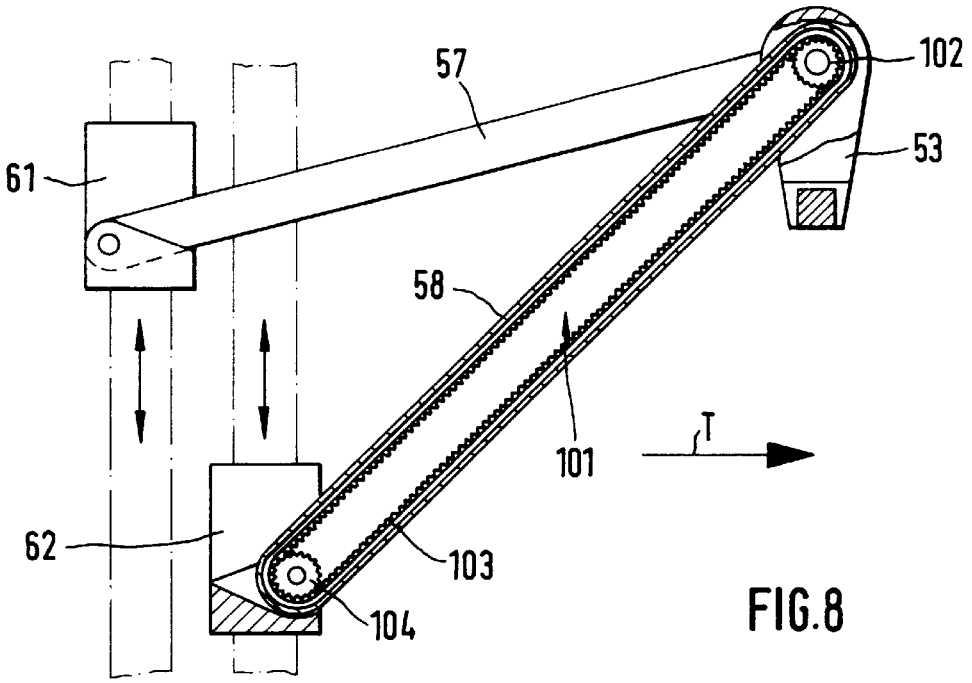
FIG. 8 is a schematic sectional view of the transfer device according to FIG. 7.
Figure 7:
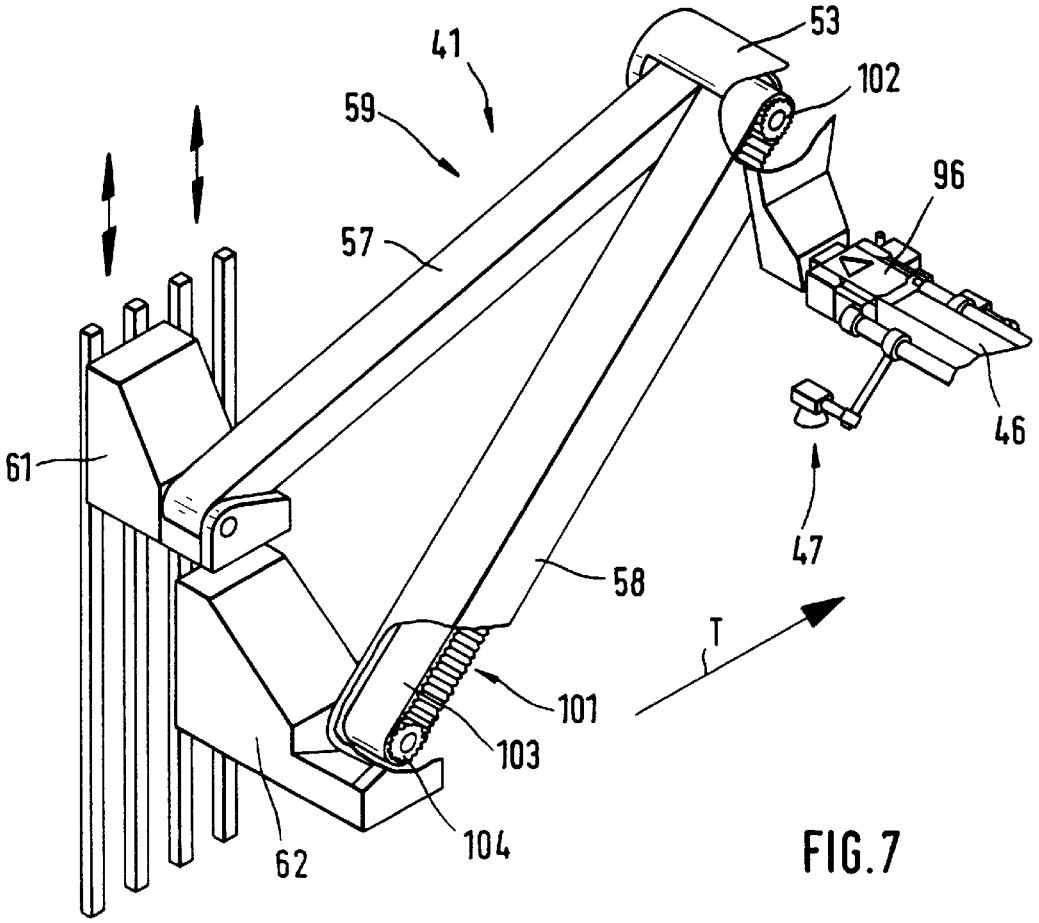
FIG. 7 is a perspective view of an alternative embodiment of the transfer device having a toothed belt module which is integrated in a control arm and defines the rotational position of the cross traverse.

A modified embodiment of the above-described two-axis transfer device is illustrated in FIGS. 7 and 8, in which case, without a repeated description the same reference symbols are used as in the above embodiments. The description applies correspondingly. As a deviation, instead of the auxiliary control arm 91, a toothed belt drive 101 is arranged in or on the control arm 58, which toothed belt drive 101 determines the rotating position of the cross traverse 46. This cross traverse 46 is non-rotatably connected with a toothed belt pulley 102 by way of which a toothed belt 103 is guided. In the case of the carriage 62, the toothed belt 103 is guided by way of a toothed belt pulley 104 which is fixedly connected with the carriage or with an actuating drive. The diameters of the toothed belt pulleys 102, 104 are preferably identical but may also be differ.

Particularly for multistation presses 1, a transfer device 41 is provided which is arranged between two working stations 2, 3. The transfer device 41 has a suction bridge 46, 47 which extends transversely to a transfer direction T and is guided on its ends by means of two control arm gearings 59, 83 synchronously along a given transfer curve K. The control arm gearings 59, 83 are formed by control arms 57, 58; 81, 82 or rods which are connected on the end side with the cross traverse 46 and which on their respective end situated away from the cross traverse 46, are held on preferably vertically aligned linear axles 69, 70; 86, 87, in which case the control arms 57, 81 and 58, 82 each, in pairs, enclose the same angle with one another. By means of the targeted controlling of the linear axles 69, 70; 86, 87, almost arbitrary transfer curves K can be travelled within the scope of the range of the transfer device 41. All linear axles are directly supported on a stationary frame 63, 64 whereby a high stiffness and precision is achieved also at high accelerations.

We claim:

1. Transfer device for workpieces to be transported on a given path for the transport of workpieces between work stations, comprising a cross traverse provided with at least one holding device for controllably receiving and releasing workpieces, a carrier device on which the cross traverse is held at ends for guiding the holding device on a predetermined closed-loop transfer curve, and a driving device which acts upon the carrier device for driving the cross traverse in two mutually independent directions and having at least one first and one second driving unit controllable in a mutually independent manner, wherein the carrier device includes a first control arm gearing including at least two control arms having first ends commonly hingedly connected with one end of the cross traverse and second ends separately hingedly connected at one of the driving units, and a second control arm gearing including at least two control arms having first ends commonly hingedly connected with another end of the cross traverse and second ends separately hingedly connected at another of the driving units, and the cross traverse is carried by the control arm gearings and is synchronously driven on ends thereof by the driving units by way of the control arm gearings.

2. Transfer device for workpieces to be transported on a given path, particularly for the transport of workpieces along several successive work stations, comprising a cross traverse provided with at least one holding device for controllably receiving and releasing workpieces, a carrier device on which the cross traverse is held at ends for guiding the holding device on a predetermined closed-loop transfer curve, and a driving device which acts upon the carrier device for driving the cross traverse in two mutually independent directions and having at least one first and one second driving unit controllable in a mutually independent manner, wherein the carrier device includes a first control arm gearing connected with one end of the cross traverse and a second control arm gearing connected with the other end of the cross traverse the cross traverse is carried by the control arm gearings and is synchronously driven on ends thereof by the driving units by way of the control arm gearings, and each control arm gearing contains at least two control arms which are stressed essentially with respect to push and pull and together enclose an angle other than zero, and the control arm gearings are configured to have the same effect.

3. Transfer device according to claim 2, wherein the driving units are connected in an articulated manner by hinges with the control arms, and the control arms are connected in an articulated manner with the cross traverse by hinges whose hinge axes are aligned substantially parallel to one another.

4. Transfer device according to claim 2, wherein each control arm of the one control arm gearing is guided in each case to a control arm of the other control arm gearing parallel and spaced therefrom.

5. Transfer device for workpieces to be transported on a given path for the transport of workpieces between work stations, comprising a cross traverse provided with at least one holding device for controllably receiving and releasing workpieces, a carrier device on which the cross traverse is held at ends for guiding the holding device on a predetermined closed-loop transfer curve, and a driving device which acts upon the carrier device for driving the cross traverse in two mutually independent directions and having at least one first and one second driving unit controllable in a mutually independent manner, wherein the carrier device includes a first control arm gearing having a first end hingedly connected with one end of the cross traverse and a second end hingedly connected at one of the driving units, and a second control arm gearing having a first end hingedly connected with another end of the cross traverse and a second end hingedly connected at another of the driving units, and the cross traverse is carried by the control arm gearings and is synchronously driven on ends thereof by the driving units by way of the control arm gearings, wherein the drive units are respective linear units whose output ends carry out a defined linear movement as a function of an input signal, and the linear units are spaced from one another and have working directions which are substantially parallel to one another.

6. Transfer device according to claim 5, wherein the driving units are direct electric drives.

7. Transfer device for workpieces to be transported on a given path for the transport of workpieces between work stations, comprising a cross traverse provided with at least one holding device for controllably receiving and releasing workpieces, a carrier device on which the cross traverse is held at ends for guiding the holding device on a predetermined closed-loop transfer curve, and a driving device which acts upon the carrier device for driving the cross traverse in two mutually independent directions and having at least one first and one second driving unit controllable in a mutually independent manner, wherein the carrier device includes a first control arm gearing having a first end hingedly connected with one end of the cross traverse and a second end hingedly connected at one of the driving units, and a second control arm gearing having a first end hingedly connected with another end of the cross traverse and a second end hingedly connected at another of the driving units, and the cross traverse is carried by the control arm gearings and is synchronously driven on ends thereof by the driving units by way of the control arm gearings, wherein at least a third control arm is part of the control arm gearing, which third control arm is connected by one end with a third driving unit and is connected by another end with the cross traverse at a hinge spaced from the hinges of the first and of the second control arm gearing which define a common swivel axis.

8. Transfer device for workpieces to be transported on a given path for the transport of workpieces between work stations, comprising a cross traverse provided with at least one holding device for controllably receiving and releasing workpieces, a carrier device on which the cross traverse is held at ends for guiding the holding device on a predetermined closed-loop transfer curve, and a driving device which acts upon the carrier device for driving the cross traverse in two mutually independent directions and having at least one first and one second driving unit controllable in a mutually independent manner, wherein the carrier device includes a first control arm gearing having a first end hingedly connected with one end of the cross traverse and a second end hingedly connected at one of the driving units, and a second control arm gearing having a first end hingedly connected with another end of the cross traverse and a second end hingedly connected at another of the driving units, and the cross traverse is carried by the control arm gearings and is synchronously driven on ends thereof by the driving units by way of the control arm gearings, wherein at least one of the control arms is part of a parallelogram guide.

9. Transfer device for workpieces to be transported on a given path for the transport of workpieces between work stations, comprising a cross traverse provided with at least one holding device for controllably receiving and releasing workpieces, a carrier device on which the cross traverse is held at ends for guiding the holding device on a predetermined closed-loop transfer curve, and a driving device which acts upon the carrier device for driving the cross traverse in two mutually independent directions and having at least one first and one second driving unit controllable in a mutually independent manner, wherein the carrier device includes a first control arm gearing having a first end hingedly connected with one end of the cross traverse and a second end hingedly connected at one of the driving units, and a second control arm gearing having a first end hingedly connected with another end of the cross traverse and a second end hingedly connected at another of the driving units, and the cross traverse is carried by the control arm gearings and is synchronously driven on ends thereof by the driving units by way of the control arm gearings, wherein at least one control arm for guiding the cross traverse is provided with a tension device gearing for connecting the cross traverse with an element 104, thereby indicating a rotating position thereof.

10. Transfer device according to claim 9, wherein the element is non-rotatably held.

11. Transfer device according to claim 9, wherein the element is held at the output end of a driving device.

12. Multistation press for the successive machining of workpieces in several steps, comprising several press stations arranged behind one another and through which the workpieces are to travel in a successive manner, and at least one transfer device for workpieces to be transported on a given path, comprising a cross traverse provided with at least one holding device for controllably receiving and releasing workpieces, a carrier device on which the cross traverse is held at ends for guiding the holding device on a predetermined closed-loop transfer curve, and a driving device which acts upon the carrier device for driving the cross traverse in two mutually independent directions and having at least one first and one second driving unit controllable in a mutually independent manner, wherein the carrier device includes a first control arm gearing including at least two control arms having first ends commonly hingedly connected with one end of the cross traverse and second ends separately hingedly connected at one of the driving units, and second control arm gearing including at least two control arms having first ends commonly hingedly connected with another end of the cross traverse and second ends separately hingedly connected at another of the driving units, and the cross traverse is carried by the control arm gearings and is synchronously driven on ends thereof by the driving units by way of the control arm gearings.

13. Multistation press according to claim 12, wherein a separately controllable transfer device is arranged between each two successive press stations.

14. Multistation press according to claim 13, wherein the transfer devices are controlled in a time-offset manner with respect to one another.

* * * * *